US010640892B2

(12) United States Patent
Brun

(10) Patent No.: US 10,640,892 B2
(45) Date of Patent: May 5, 2020

(54) INCORPORATION OF CHIP ELEMENTS IN A CORE YARN

(71) Applicant: COMMISSARIAT À L'ENERGIE ATOMIQUE ET AUX ENERGIES ALTERNATIVES, Paris (FR)

(72) Inventor: Jean Brun, Champagnier (FR)

(73) Assignee: COMMISSARIAT À L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 136 days.

(21) Appl. No.: 15/767,985

(22) PCT Filed: Oct. 10, 2016

(86) PCT No.: PCT/FR2016/052610

§ 371 (c)(1),
(2) Date: Apr. 12, 2018

(87) PCT Pub. No.: WO2017/064402

PCT Pub. Date: Apr. 20, 2017

(65) Prior Publication Data

US 2018/0355524 A1 Dec. 13, 2018

(30) Foreign Application Priority Data

Oct. 12, 2015 (FR) ..... 15 59671

(51) Int. Cl.
*D02G 3/38* (2006.01)
*D02G 3/44* (2006.01)
(Continued)

(52) U.S. Cl.
CPC ..... *D02G 3/38* (2013.01); *D02G 3/365* (2013.01); *D02G 3/404* (2013.01); *D02G 3/441* (2013.01); *D02J 13/00* (2013.01); *D10B 2331/02* (2013.01); *D10B 2331/04* (2013.01); *D10B 2401/041* (2013.01); *D10B 2401/18* (2013.01)

(58) Field of Classification Search
CPC ..... D02G 3/365; D02G 3/38; D02G 3/441
See application file for complete search history.

(56) References Cited

U.S. PATENT DOCUMENTS 3,382,655 A * 5/1968 Wasserman ..... D02G 3/12 57/16
3,599,679 A * 8/1971 Carter ..... D02G 3/40 139/420 R
(Continued)

FOREIGN PATENT DOCUMENTS

GB 2 426 255 A 11/2006
GB 2 472 025 A 1/2011
(Continued)

*Primary Examiner* — Shaun R Hurley
(74) *Attorney, Agent, or Firm* — Oliff PLC

(57) ABSTRACT

A fabrication method of a sheathed yarn includes the following steps: making a core run axially through a sheathing area; winding a sheathing fibre around the core in the sheathing area; and presenting a microelectronic chip fixed onto the core in the sheathing area. A polymer material is present between the microelectronic chip and the core when the sheathing step is performed. The polymer material creeps during the sheathing step to form a protective coating.

12 Claims, 4 Drawing Sheets

(51) Int. Cl.

| | |
|---|---|
| ***D02G 3/36*** | (2006.01) |
| ***D02G 3/40*** | (2006.01) |
| ***D02J 13/00*** | (2006.01) |

(56) References Cited

U.S. PATENT DOCUMENTS

| | | | | |
|---|---|---|---|---|
| 4,232,507 | A * | 11/1980 | Northup | D02G 3/362 57/16 |
| 8,814,054 | B2 | 8/2014 | Brun et al. | |
| 2006/0026944 | A1* | 2/2006 | Ueda | D02G 3/06 57/210 |
| 2009/0139198 | A1* | 6/2009 | Dias | D02G 3/404 57/210 |
| 2013/0092742 | A1 | 4/2013 | Brun et al. | |
| 2017/0275789 | A1* | 9/2017 | Dias | D02G 3/36 |

FOREIGN PATENT DOCUMENTS

| | | | |
|---|---|---|---|
| GB | 2 472 026 | A | 1/2011 |
| JP | 2013-189718 | A | 9/2013 |
| WO | 2009/004243 | A2 | 1/2009 |

* cited by examiner

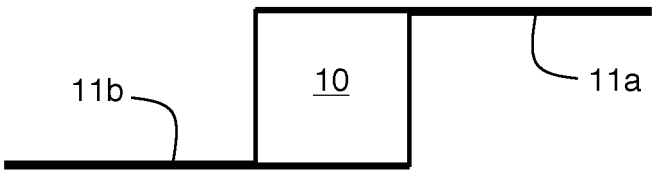
Fig 1
Fig 2a
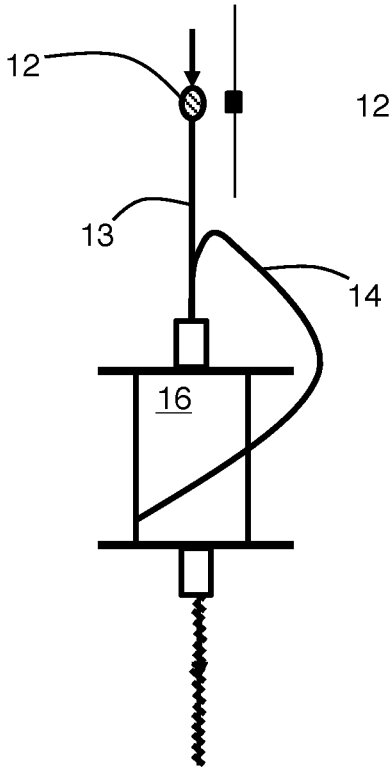
Fig 2b
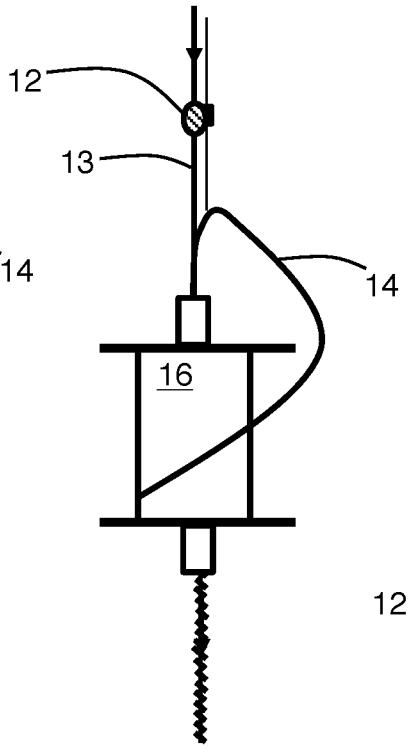
Fig 2c
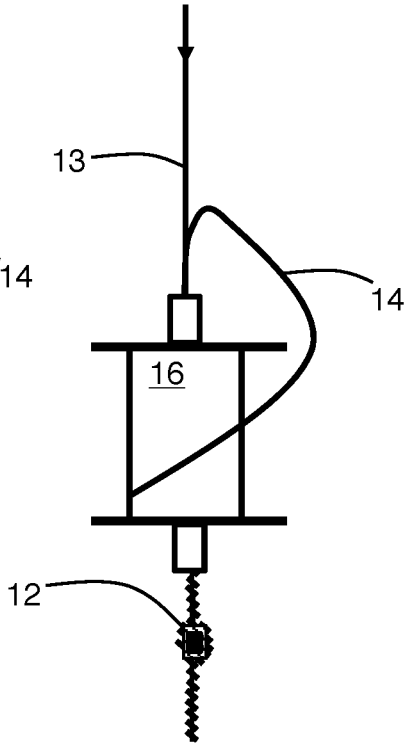

Fig 6
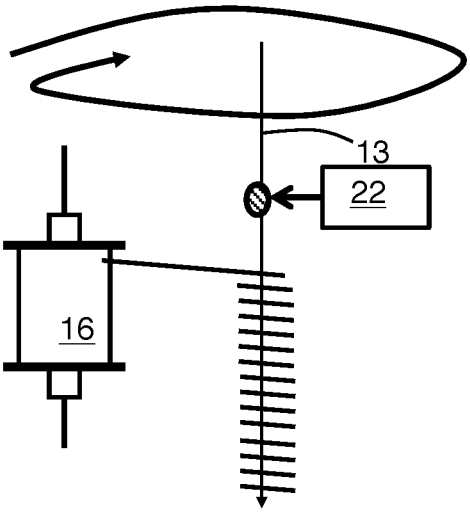
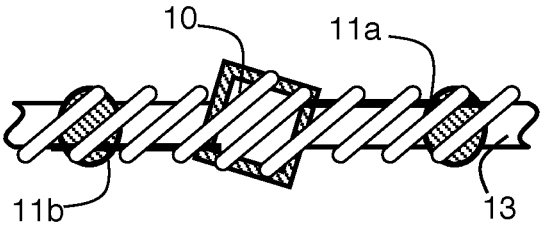
Fig 7

INCORPORATION OF CHIP ELEMENTS IN A CORE YARN

BACKGROUND OF THE INVENTION

The invention relates to microelectronic chip elements and more particularly to microelectronic chips, the largest dimension of which may be smaller than one millimetre. The invention relates more particularly to a packaging method of such chip elements to make storage and handling of the latter easier.

STATE OF THE ART

FIG. 1 schematically represents a miniaturized radiofrequency transceiver device serving the purpose for example of contactless identification (RFID device). The device comprises a chip element 10, of general parallelepiped shape, incorporating a chip which integrates all the RFID functions.

The device comprises a dipole antenna formed by two sections of conducting yarn 11*a* and 11*b*. These sections, securedly attached to two opposite surfaces of element 10, are connected to terminals of the chip and extend in opposite directions.

Since the large side of the chip element 10 may be smaller than 1 mm, these devices are not produced and handled by methods used for larger devices.

Patent application WO2009004243 describes an example of a method for producing RFID devices of the type of FIG. 1. Once formed, these devices have to be incorporated in the objects to be identified. This gives rise to handling problems, as the antennas have to remain substantially rectilinear, or at least not be twisted so that they short-circuit.

The document US 2013-0092742 describes a method for fixing chip elements on a core to form a wrapped yarn. The chip elements are gripped by a sheathing fibre which secures the chip elements on the core by compressing them.

In alternative manner, the document GB2472025 proposes to bond a semiconductor chip with a yarn. Bonding can be performed by means of a resin. Depending on the embodiments, the resin can be applied over the whole length of the yarn, on the chip or on a substrate supporting the chip. It is also possible to use an additional element comprising the resin. This additional element is located between the yarn and the chip.

The document GB2472026 describes an assembly of a semiconductor chip provided with conductive elements inside a yarn. Conducting wires can be inserted to provide the electric power supply. The chip is inserted into a carrousel the periphery of which contains a multitude of yarns. The yarns can be coated with resin.

The document GB2426255 also describes an assembly of a semiconductor chip provided with conductive elements inside a yarn. The chip is arranged in a volume of resin which is closed at its periphery by contiguous yarns.

The document JP2013-189718 proposes to place an electronic article on a yarn and to surround the electronic article and the yarn by an additional yarn in order to bond them together.

It is apparent that in these different embodiments and for certain applications the functionality of the sheathed yarn is reduced in time. Malfunctions are observed which reduces the advantages of this innovation for certain applications.

SUMMARY OF THE INVENTION

A solution is therefore required to increase the resistance in time of the functionalities of the sheathed yarn while at the same time preserving the ability to handle chip elements in groups or individually, in particular when they are of very small size, notably when the latter are provided with sections of yarn.

To tend to meet this requirement, a fabrication method of a sheathed yarn is provided comprising the following steps:

- Providing a core and at least one microelectronic chip associated with sections of yarn;
- Placing the microelectronic chip and the sections of the yarn in contact with the core;
- Winding at least one sheathing fibre around the microelectronic chip, the sections of yarn and the core in at least one sheathing area to form the sheathed yarn.

The method is remarkable in that a polymer material is present between the core and the microelectronic chip before the sheathing fibre is wound around the microelectronic chip and the core, and in that the sheathing fibre is wound around the microelectronic chip and the core so as to force the polymer material to creep through the turns of the sheathing fibre to form a protective coating around the microelectronic chip.

A sheathed yarn is also provided comprising a core around which at least one sheathing fibre is wound, and at least one microelectronic chip sandwiched between the core and the sheathing fibre. The sheathed yarn is remarkable in that it comprises a polymer material coating the microelectronic chip, the sheathing fibre comprising a peripheral area devoid of polymer material.

BRIEF DESCRIPTION OF THE DRAWINGS

Other advantages and features will become more clearly apparent from the following description of particular embodiments of the invention given for non-restrictive example purposes only and illustrated by means of the appended drawings, in which:

FIG. 1, previously described, schematically represents a chip element provided with a dipole antenna;

FIGS. 2*a*, 2*b* and 2*c* schematically represent different steps of a sheathing method in a sheathing installation used to incorporate chip elements on a yarn provided with a bonding area;

FIG. 6 schematically represents a further variant of a sheathing installation used to incorporate chip elements on a yarn;

FIG. 7 schematically represents a section of sheathed yarn produced by means of the foregoing installations.

DESCRIPTION OF A PREFERRED EMBODIMENT OF THE INVENTION

To facilitate handling of individual chip elements of very small size (able to be smaller than 1 mm), it is proposed incorporate them in spaced apart manner in a sheathed yarn. The chip elements will be sandwiched between the core of the yarn and a sheathing fibre wound in a spiral around the core, i.e. in the form of spiral turns. It is also possible to use several different or identical sheathing fibres successively wound in a spiral around the core. Spiral turns of sheathing fibre are made around the assembly formed by the core and the microelectronic chip. The core yarn presents a longitudinal axis which is identical or substantially identical to the longitudinal axis of the assembly, which is not the case of the sheathing fibre.

This embodiment is more advantageous than formation of a sheath around the chip by means of a plurality of sheathing fibres without using a core, as the position of the chip is better controlled and the resistance in time is improved. Using a core yarn ensures that the microelectronic chip is correctly guided when wrapping of the sheathing fibre is performed. By wrapping the sheathing fibre around the chip placed on the core, it is possible to reduce the risks of random coiling and the risks of folding of the antennas when the latter are present on the chip.

In order that the chip elements, also called microelectronic chips, do not tend to slip out between the consecutive turns of the sheathing fibre, the latter are advantageously provided with sections of yarn also sandwiched between the core and the sheathing fibre. These sections of yarn could advantageously be the dipole antennas of chip elements integrating radiofrequency transceiver or RFID functions.

The wound or coiled sheathed yarn is easy to handle. Apart from the fact that the yarn will be able to be used to manufacture fabrics, it will be able to be cut and incorporated manually or in automated manner in other objects, limiting the risks of losing the chip elements or of twisting the dipole antennas.

The core can be formed by a mono-filament or by multi-filaments, the multi-filaments advantageously being braided.

Figure 3A:
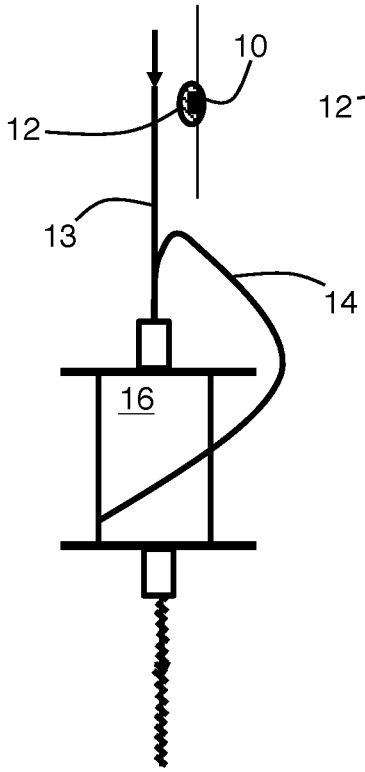
FIGS. 3*a*, 3*b* and 3*c* schematically represent different steps of a sheathing method in a sheathing installation used to incorporate chip elements on a yarn, the chip element being at least partially covered by a bonding area.
Figure 3B:
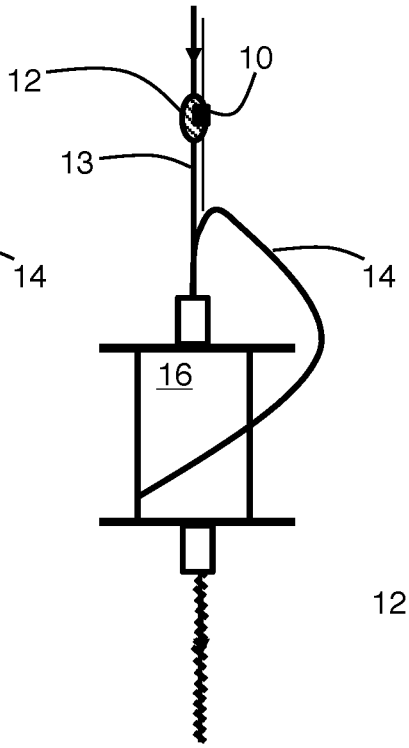
Figure 3C:
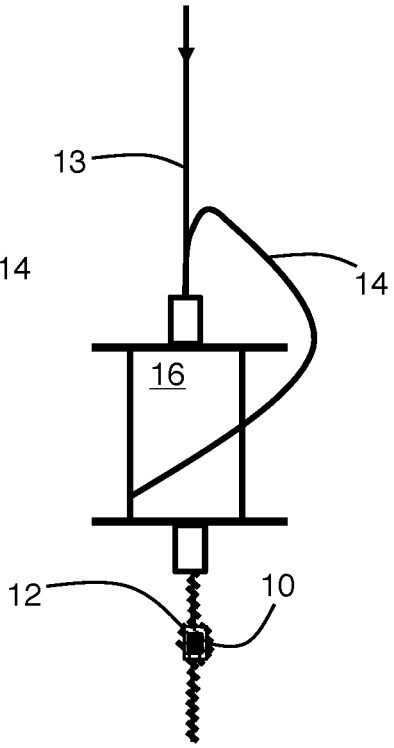

As illustrated in FIGS. 2*c*, 3*c* and 7, in order to protect the microelectronic chips 10 against aggressions from the outside environment, it is particularly advantageous to protect them by means of a polymer material 12 which will form a protective coating, i.e. a protective shell.

The polymer material 12 will also perform bonding between the microelectronic chip 10, the core 13 and the turns of the sheathing fibre 14 which improves the resistance in time of the sheathed yarn by reducing the friction between the turns. This friction may lead to damaging of the sheathing fibres 14, for example severing. Once the sheathing fibres 14 have been severed, it is possible for the chip to slide out of the sheathed yarn.

Depending on the embodiments, the sheathing fibre can completely cover the core 13 or partially cover the latter so as to define covered areas and uncovered areas. The covered area advantageously comprises a micro-electronic chip.

In particularly advantageous manner, the protective coating of polymer material 12 is hermetic so as to prevent moisture from reaching the microelectronic chip 10.

A simple way of protecting the chip 10 is to produce the sheathed yarn and then to coat the assembly in polymer material 12. Coating is then performed after the microelectronic chip 10 has been placed in contact with the core 13 and after the turns of sheathing fibre 14 have been formed.

It has been observed that this type of encapsulation is not completely satisfactory as it is difficult for the polymer material 12 to infiltrate through the turns and reach the microelectronic chip 10. Holes exist where the polymer material 12 is absent which facilitates for example infiltration of moisture. It has also been observed that the protection level is lower the farther the polymer material 12 is located from the microelectronic chip 10, outside the sheathed yarn and therefore in an area which is particularly subject to wear.

It has further been observed that the probability of obtaining a coating extending up to the microelectronic chip 10 is lower the higher the viscosity of the polymer material, for example in the 5000 mP/s-50000 mP/s range. Such a viscosity value can be obtained when deposition of the polymer material 12 is performed, which can take place at ambient temperature, for example between 20° C. and 30° C. The probability of obtaining a coating extending up to the microelectronic chip 10 is also a function of the wettability which is a parameter depending on the surface state of the sheathed yarn, the core and the microelectronic chip.

As indicated in the foregoing, sheathing is performed by wrapping the sheathing fibre 14 around the assembly formed by the core 13 and chip 10. This embodiment enables the pressure applied by the sheathing fibre to be better controlled, thereby resulting in better control of expulsion of the polymer material. Such a control of expulsion of the resin is difficult to achieve in the embodiment of the document GB2472026 which does not provide for rotation of the fibres, or even for the use of a core yarn.

It has also been observed that when a polymer material 12 comprising fillers, for example metal or alumina fillers, is used, the latter have difficulty in reaching the microelectronic chip 10. A great majority of the fillers are present at the surface of the sheathed yarn, i.e. around the sheathing fibres 14. The fillers have difficulty in passing through the spiral turns to reach the inside of the sheathed yarn, i.e. the core 13 and microelectronic chip 10.

In this exemplary case, the fillers cannot perform their function in proximity to the microelectronic chip 10 as they are absent or in small quantity. In addition, the cluster of fillers is liable to form an excess thickness which may be inconvenient for the future applications of the sheathed yarn. This cluster will also wear more quickly as it is present in the form of an excess thickness around the spiral turns.

In order to facilitate penetration of the polymer material 12 as close as possible to the microelectronic chip 10, different methods are possible. A first method is to apply a pressure around the sheathed yarn covered by polymer material 12 so as to force it to infiltrate through the spiral turns. This implementation is particularly complex to achieve and does not enable any fillers of the polymer material 12 that may exist to be placed in close proximity to the microelectronic chip 10.

An advantageous embodiment is to place the polymer material 12 between the core 13 and the microelectronic chip 10 before the sheathing step, i.e. before forming the turns of sheathing fibre 14. Depending on the embodiments, the sheathing fibre is formed by a mono-filament or by multi-filaments, and the multi-filaments are advantageously braided. This embodiment enables a large quantity of fillers to be preserved in immediate proximity to the chip. In such an embodiment, it is possible to obtain a filler concentration that decreases when going from the chip 10 to the periphery of the assembly.

It may be advantageous to use electrically insulating fillers and/or fillers formed from oxides.

It is advantageous to choose fillers that are configured to improve the thermomechanical properties of the polymer material 12 and in particular to bring the thermomechanical properties of the polymer material 12 accompanied by its fillers closer to the equivalent thermomechanical properties of the microelectronic chip 10.

In this way, by incorporating specific fillers in the polymer material 12, the assembly formed by the polymer material 12 and the fillers presents thermomechanical properties that are closer to those of the microelectronic chip 10.

It is particularly advantageous to choose fillers that are configured to bring the coefficient of thermal expansion of the assembly formed by the polymer material 12 and the fillers closer to the coefficient of thermal expansion of the microelectronic chip 10. The coefficient of thermal expansion is for example the coefficient of linear thermal expansion.

It is also particularly advantageous to provide fillers that are configured to bring the coefficient of thermal conduction of the assembly formed by the polymer material 12 and the fillers closer to the coefficient of thermal conduction of the microelectronic chip 10.

Under these conditions, the protective coating present around the chip is able to place fillers in immediate proximity to the chip in order to protect it efficiently against moisture, and the fillers also enable mechanical stresses to be reduced when the temperature of the chip and that of the protective coating change.

Depending on the embodiments, the fillers present a coefficient of thermal expansion, that may be linear, and/or a coefficient of thermal conduction that are strictly lower than that/those of the polymer material and which are advantageously lower than or equal to that/those of the microelectronic chip 10 and even more advantageously which are lower than or equal to that/those of the microelectronic chip 10.

It is also possible to provide for the fillers to be formed by different materials for example with a first part of the fillers presenting a coefficient of thermal conduction comprised between that of the polymer material 12 and that of the microelectronic chip 10 and/or a second part presenting a coefficient of thermal conduction equal to that of the microelectronic chip 10 and/or a third part presenting a coefficient of thermal conduction lower than that of the microelectronic chip 10. The same may be the case for the coefficient of thermal expansion.

In the case where the chip 10 is formed on a silicon substrate, it is advantageous to use fillers which present a coefficient of thermal expansion and/or of thermal conduction equal or substantially equal to those of silicon.

In a particular exemplary embodiment illustrated in FIGS. 2*a*, 2*b* and 2*c*, the polymer material 12 covers the core 10 and the microelectronic chip 14 is placed on the polymer material 12. Depending on the different cases, the core 13 can be totally or partially covered by the polymer material 12. In case of partial coverage, it is advantageous to use the area made from polymer material 12 as receiving area to place the microelectronic chip 10. The sheathing fibre 14 is advantageously supplied from a roller 16.

FIG. 2*a* illustrates supply of a core partially covered by the polymer material 12 and supply of a microelectronic chip 10. FIG. 2*b* illustrates placing of the chip 10 on the core 13. The chip 10 is fixed by means of the polymer material 12 which performs bonding between the chip 10 and core 13. FIG. 2*c* illustrates formation of the spiral turns of sheathing fibres 14 which will compress the polymer material. The polymer material will creep so as to form a protective sleeve around the chip 10.

In an alternative embodiment illustrated in FIGS. 3*a*, 3*b* and 3*c*, the polymer material 12 covers the microelectronic chip 10 and the covered microelectronic chip 10 is placed on the core 13. Depending on the embodiments, the chip 10 can be totally or partially covered by the polymer material 12.

FIG. 3*a* illustrates supply of a core 13 and supply of a microelectronic chip 10 partially covered by the polymer material 12. FIG. 3*b* illustrates the placing of the chip 10 on the core 13. The chip 10 is secured by means of the polymer material which performs bonding between the chip 10 and core 13. FIG. 3*c* illustrates formation of the spiral turns of sheathing fibres 14 which will compress the polymer material. The polymer material will creep so as to form a protective sleeve around the chip 10.

It is further possible to provide a combination of these two embodiments, i.e. for the microelectronic chip 10 and core 13 are to be covered by a polymer material 12. It is possible to use a single polymer material or two different polymer materials to cover the core 13 and microelectronic chip 10.

The microelectronic chip 10 is therefore placed on the core 13 by means of the polymer material 12 which keeps these two parts in place during formation of the turns. The polymer material 12 is advantageously a glue. The chip 10 can be placed on the core 13 when the core 13 is moving or when the core 13 is not moving.

When the sheathing fibre 14 is wound around the microelectronic chip 10 and the core 13 in the sheathing area to form the sheathed yarn, the polymer material 12 is present between the core 13 and microelectronic chip 10 and will creep through the spiral turns of the sheathing fibre 14 so as to form a protective layer. If the sheathing fibre 14 is a multi-filament fibre, the polymer material 12 advantageously creeps between the filaments of the fibre 14.

In this configuration, the polymer material 12 is in immediate proximity to the microelectronic chip and core. When creepage takes place, the polymer material will coat the core and chip before or during infiltration of the polymer material through the turns of sheathing fibre 14. The polymer material goes advantageously between the turns of the sheathing fibre 14.

In this way, the protective layer around the microelectronic chip 10 and around the core 13 is of better quality as it is more continuous. The probability of having a hole allowing moisture or impurities to penetrate is reduced. This effect is particularly marked when the polymer material 12 has a high viscosity, for example in the range indicated in the foregoing. It is also apparent that when the polymer material 12 contains fillers, for example the fillers indicated in the foregoing, the latter are mainly concentrated around the microelectronic chip and the core 13 as the sheathing fibre 14 in the form of spiral turns slows down their progression to the outside of the sheathed yarn. In this configuration, the excess thicknesses are reduced or even non-existent.

In these particular cases, the polymer material 12 binds the microelectronic chip 10 with the core 13 and the turns which increases the lifetime of the sheathed yarn.

In a particular embodiment, the tension applied by the sheathing fibre 14 during formation of the turns and the polymer material 12 are configured to make a part of the polymer material 12 creep through the turns during the formation step of the turns.

In an alternative embodiment, the spiral turn applies a stress on the assembly formed by the core 13, microelectronic chip 10 and polymer material 12. An anneal can be applied on the assembly so as to increase the fluidity of the polymer material 12 which will creep more easily through the spiral turns. The temperature rise will accentuate the infiltration phenomenon of the polymer material 12 in similar manner to an improvement of the wettability. Tests have been carried out with the E505 glue from the EPO-TECHNY Company. It was observed that, when the temperature was increased to 160° C., the glue becomes more fluid and that it wets the core 13 and microelectronic chip 10 better. The sheathing fibre 14 is at a first temperature in the coil 16 and is wound on the core 13 at a second temperature which can be identical to or different from the first temperature. The annealing step advantageously results in an increase of the temperature of at least 5° C., preferably of at least 10° C.

In an advantageous embodiment, an annealing step is performed after formation of the sheathed yarn. The anneal is configured so as to cause polymerization of the polymer material which will bond the microelectronic chip 10 in lasting manner with the core 13 and the turns. The anneal can be used to accelerate polymerization. The annealing step advantageously results in an increase of the temperature of at least 5° C., preferably of at least 10° C. This embodiment is particularly advantageous to cross-link or to speed up cross-linking of the polymer material 12 and prevent deformation of the latter in time. The polymer material 12 is for example a partially cross-linked thermosetting material or a glue. The polymer material can for example be an epoxy glue able to be formed in two steps for example with a hot impregnation followed by an annealing step. This type of epoxy glue is used for example to form high-density printed circuits. As a variant, it is also possible to use an UV glue which polymerizes at the surface when exposure is performed and then polymerizes to the core when a subsequent anneal is performed. In another embodiment it is further possible to anneal the polymer material at a temperature close to the glass transition temperature in order to reduce its viscosity and to make it less tacky to the touch. What is meant by temperature close to the glass transition temperature is advantageously a temperature comprised between +10° C. and −10° C. with respect to the glass transition temperature and even more advantageously a temperature comprised between +5° C. and −5° C. with respect to the glass transition temperature. A second anneal at a higher temperature is performed in order to finalize the cross-linking.

Polymerization of the glue is advantageously performed between 130° C. and 220° C. The glue can be an epoxy glue, for example a TC420 epoxy glue marketed by the POLY-TECH PT Company or an E514 epoxy glue marketed by the EPOTECHNY Company.

In addition, after formation of the sheathed yarn, it is particularly advantageous to wind the sheathed yarn to form a coil. In this configuration, it is particularly advantageous to perform a first anneal after formation of the sheathed yarn and before coiling is performed. The object of this first anneal is to perform partial polymerization of the polymer material, for example of the glue. This first anneal is advantageously performed in a temperature range comprised between 130° C. and 200° C. After this first anneal, the sheathed yarn can be coiled and a second anneal is preferably performed on the coil of yarn. This second anneal is configured to complete polymerization of the glue and preferably to obtain total polymerization of the glue. The second anneal is advantageously performed in a temperature range comprised between 150° C. and 220° C. The temperature of the second anneal is higher than the temperature of the first anneal. It is particularly advantageous to perform the first anneal during the winding phase which enables a better control of the viscosity to be achieved. This embodiment is particularly advantageous for epoxy glues having a viscosity which decreases for a few seconds when the temperature increases, for example from 40° C. to 80° C., before increasing again due to the cross-linking effect. An increased impregnation of the glue then takes place in the inner part of the sheathed yarn followed by a blocking of outwards diffusion on account of the fact that the polymer material has reacted.

In an alternative embodiment, the polymer material 12 is a thermoplastic material. It is particularly advantageous to heat the thermoplastic material before placing the microelectronic chip on the core by means of a first anneal. Heating the thermoplastic material softens the latter and increases its binding power. Accordingly, the microelectronic chip 10 is bound to the core 13 by means of the polymer material 12 during the sheathing step which is particularly advantageous to ensure correct placing of the microelectronic chip 10 on the core 13. The first anneal is advantageously performed in a temperature range comprised between 150° C. and 200° C. The anneal can be performed by heating the coil 16 or advantageously by heating the polymer material 12 between exit from the coil and binding with the core.

A second anneal is then performed, after the sheathing step, so as to make the polymer material creep around the microelectronic chip 10 and around the core 13 until it reaches the sheathing fibre 14. The second anneal is advantageously performed in a temperature range comprised between 160° C. and 240° C. The temperature of the second anneal can be higher or lower than the temperature of the first anneal as the object is to transform the polymer material to the pasty state. The temperature difference between the two anneals is advantageously at least 5° C., preferably at least 10° C.

The polymer material 12 can be chosen from polyurethanes or silicones.

In an even more particular embodiment, the core 13 and polymer material 12 are made from thermoplastic materials or comprise a thermoplastic material. Depending on the embodiments, the same thermoplastic material or two different thermoplastic materials can be used to form the core 13 and polymer material 12.

If the core 13 is a multi-filament core, it is advantageous to provide at least one filament made from thermoplastic material and advantageously from the same thermoplastic material as that used for the polymer material 12. It is also advantageous to use different materials, for example different thermoplastic materials which will creep differentially, which enables the mechanical properties of the core 13 or of the polymer to be preserved during fabrication of the latter.

It is further possible to provide a core made from a first material covered by a thermoplastic material different from the material of the core. As a variant, the core 13 can be completely formed by a thermoplastic material. In this case, it is advantageous to make the core 13 from a thermoplastic material having a glass transition temperature higher than that of the thermoplastic material forming the polymer material in order to preserve the mechanical integrity of the assembly when the anneals are performed. For example, a temperature difference of 10° C. is advantageously chosen.

The second anneal can be configured so as to make the polymer material 12 and a part of the core 13 creep around the microelectronic chip 10 until they reach the sheathing fibre 14.

In yet another alternative embodiment, the core 13 is formed by filaments made from thermosetting material and the polymer material 12 is formed in the core 13 by filaments of thermoplastic material. The thermoplastic material is present in the core 13 and also at its periphery. During the previous two anneals, the thermoplastic material reacts to bind the microelectronic chip and then to encapsulate it.

The core 13 is for example made from Co-Polyester (Co PES) or Co-Polyamide (Co PA) multi-filaments, such a yarn being for example marketed by the DISTRICO company under the name of GRILON® thermobonding yarn. It is possible to use yarns formed by a polyamide/polyester core associated with a Co-Polyester (Co PES) or Co-Polyamide sheath. These yarns are sold under the name of GRILON® bi-component yarns. It is further possible to use a core 13 for example made from Co-Polyester (Co PES) or Co-Polyamide (Co PA) multi-filaments associated with a non-fusible core yarn marketed under the name of GRILON® thermo-bonding combi yarn.

Placing the polymer material in direct contact with the microelectronic chip 10 before formation of the turns enables the quantity of polymer material 12 used to be reduced while at the same time performing optimal protection of the chip 10. This enables the cluster of material around the sheathed yarn to be reduced or even avoided. Reducing the quantity of polymer material also enables the differences of mechanical behaviour between the areas with chip and polymer material and the areas without chip and without polymer material to be reduced.

It is then possible to choose the quantity of polymer material 12 so that the polymer material 12 does not overspill beyond the last layer of turns of sheathing fibre 14 when creepage takes place. It is even more advantageous to choose the quantity of polymer material 12 so that the polymer material 12 leaves an external area devoid of polymer material 12 on the different turns surrounding the microelectronic chip 10. For example, for a unit of given length, the volume of polymer material 12 is smaller than the volume of wound sheathing fibre 14. This external area can have the form of a continuous ring around the chip 10.

To bond the microelectronic chip 10 to the core 13, it appears judicious to use several dissociated bonding areas i.e. at least two areas provided with polymer material 12 separated by an area devoid of polymer material 12.

This embodiment is particularly advantageous when the microelectronic chip 10 comprises a RFID device equipped with an antenna. The antenna is fixed to the core by means of a specific area made from polymer material 12.

Figure 4:
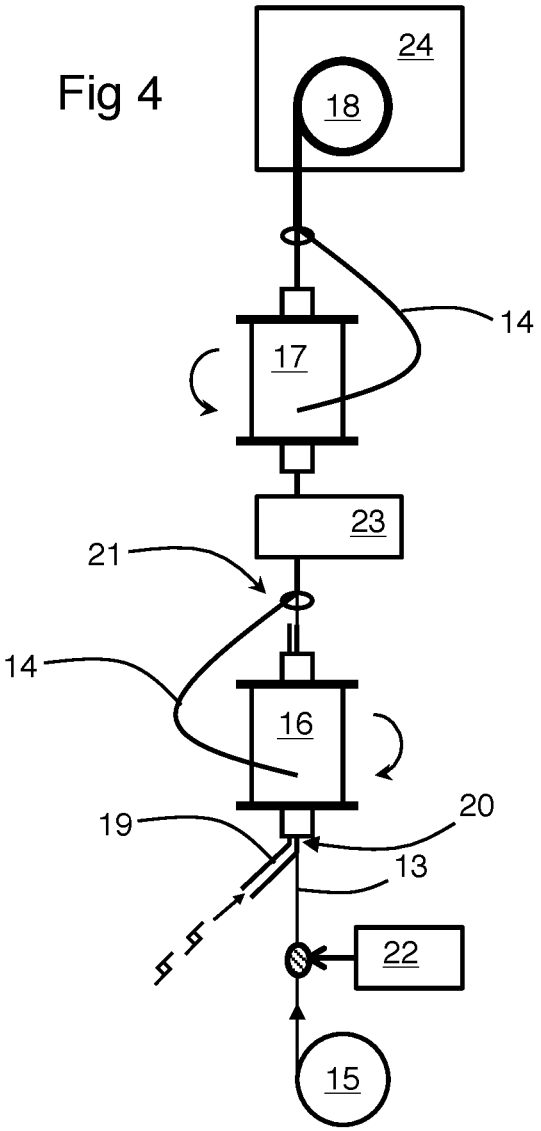
FIG. 4 schematically represents a sheathing installation used to incorporate chip elements on a yarn.

FIG. 4 schematically represents a conventional sheathing installation able to be used to incorporate chip elements 10 in a sheathed yarn by performing simple modifications.

A core 13 is unwound from a feed coil 15, passes axially through two successive rollers 16 and 17, and ends up wound onto a receiving coil 18. Each of the rollers 16 and 17 stores a sheathing fibre and is associated with a mechanism rotating around the core during unwinding, and winding the sheathing fibre around the latter. The two winding mechanisms rotate in opposite directions resulting in the exiting sheathed yarn comprising two layers of sheathing fibre formed by spirals of opposite directions. The ratio of the running speed of the core and the speed of rotation of the winding mechanisms defines the pitch of the spirals.

As represented, it is conventional to work in the vertical direction from the bottom up, i.e. the feed coil 15 is located at the bottom and the receiving coil 18 at the top. The winding mechanisms are, in FIG. 4, designed to wind the sheathing fibre around the core 13 on exit from the rollers (in the direction of winding of the core). However, a horizontal configuration is not prohibited.

In order to incorporate chip elements in the yarn during formation of the latter, an insertion device 19 is provided, preferably at the location of the first roller 16. This insertion device 19, for example in the form of a tube of a suitable diameter for the chip elements 10, guides the latter to a fixing area 20 where the chip is fixed onto the core 13.

The chip fixed onto the core 13 then reaches a sheathing area 21 where the sheathing fibre of the roller 16 is wound around the core 13. This tube passes through the roller 16 from bottom to top and comes out near the area 21. As a variant, the guide tube can be replaced by a chute, i.e. a half-tube in the longitudinal direction, or by a roller-based guiding system.

The individual elements 10 are for example projected by means of compressed air through the tube 19 to be bound to the core by means of the polymer material. The core then moves to the area 21 where the chips 10 and core 13 are compressed by the sheathing fibre during winding.

In advantageous manner, the microelectronic chip 10 is moved in a direction parallel to the core 13.

Figure 5:
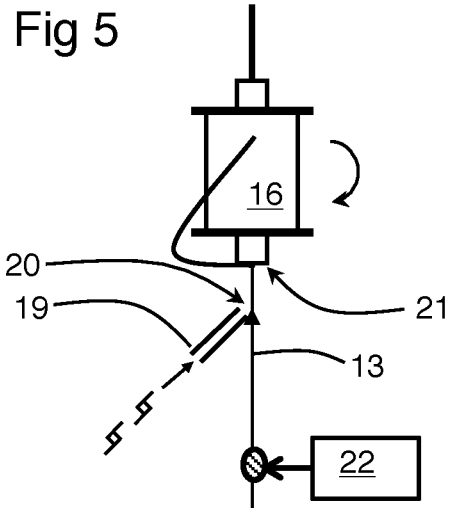
FIG. 5 schematically represents a variant of a sheathing installation used to incorporate chip elements on a yarn.

FIG. 5 represents another possible configuration of the roller 16 with its winding mechanism. Winding of the sheathing fibre around the core 13 takes place at the entrance of the roller (in the direction of movement of the core 13). The sheathing area 21 is therefore situated at the entrance of the roller 16. This configuration makes it possible to use a shorter insertion device 19 as it no longer has to pass through the roller 16. This makes feeding of the insertion device with chip elements 10 easier to perform.

In order to allow feeding of the insertion device 19 by gravity, which would further simplify the method, it can be envisaged to reverse the installation, i.e. to make the core 13 run from the top downwards.

FIG. 6 represents yet another possible configuration where a coil of sheathing fibre moves around the core yarn 13 and is unwound so that the sheathing fibre is wound around the core 13. The movement of the coil 16 around the core 13 is represented by the arrow.

In a first embodiment illustrated in FIG. 4, the core 13 leaves the coil 15 devoid of polymer material 12. A deposition area of the polymer material is present between the coil 15 and the area 20 where the chip 10 is fixed to the core 13. The deposition machine 22 deposits polymer material on the core 13.

Deposition of the polymer material 12 can be performed by means of any known technique. The polymer material 12 can be deposited in continuous manner to cover the whole length of the core 13 or discontinuously to form areas of polymer material 12 separated by areas without any polymer material 12.

Discontinuous deposition can be performed by deposition of one or more drops of polymer material 12 on the core 13. It is further possible to deposit the polymer material 12 on the core 13 by projection, for example by means of a jet of polymer material 12. Discontinuous deposition of polymer material 12 can further be performed by coating.

Deposition by jet of material 12 or formation of drops can be achieved by means of equipment marketed by the Nordson Asymtek Company. Formation of drops can also be achieved by dipping a tip into the polymer material 12 in liquid state followed by transfer onto the core 13 by contact between the core 13 and the tip or possibly the liquid polymer material 12.

The polymer material 12 can be deposited on the core 13 when the latter is moving or the core 13 is stopped in order to place the polymer material 12.

What is just been presented for deposition of the polymer material 12 on the core 13 can also be performed for deposition of the polymer material 12 on the chip 10.

As indicated in the foregoing, if anneals are used to enhance polymerization of the polymer material 12, it is advantageous to place a furnace 23, 24 after the roller 16, for example between roller 16 and roller 17 or after roller 17. In the example illustrated in FIG. 4, a first furnace 23 is placed between rollers 16 and 17 and a second furnace 24 is placed in such a way as to anneal the coil 18.

FIG. 7 represents a section of sheathed yarn obtained on output from the first roller 16, illustrating a chip element 10 with its sections of yarn 11*a* and 11*b* sandwiched between the core 13 and the sheathing fibre, wound to form a spiral, coming from the roller 16. It is sought to have sections of yarn 11*a* and 11*b* substantially parallel to the core 13, as represented.

For this type of microelectronic chip 10, it is advantageous to use several distinct areas of polymer material in order to bond the chip to the core in the required configuration. For example, three distinct areas of polymer material are used. A first area of polymer material is used to bond and encapsulate and the chip 10. Two additional areas of polymer material are preferably used at the ends of the sections of yarns 11*a* and 11*b* in order to fix the orientation of the antennas of the chip 10.

The quantity of polymer material can be reduced enabling the final volume occupied by the polymer material to be limited.

The invention claimed is:

1. Fabrication method of a sheathed yarn, comprising the following steps:

providing a core and at least one microelectronic chip associated with sections of yarn;

providing a polymer material comprising fillers;

placing the at least one microelectronic chip and the sections of the yarn in contact with the core;

winding at least one sheathing fibre around the at least one microelectronic chip, the sections of yarn and the core in at least one sheathing area to form the sheathed yarn;

wherein the polymer material is present between the core and the at least one microelectronic chip before the sheathing fibre is wound around the at least one micro-electronic chip and the core;

wherein the sheathing fibre is wound around the at least one microelectronic chip and the core so as to force creepage of the polymer material through turns of the sheathing fibre to form a protective coating around the at least one microelectronic chip preventing moisture from reaching the at least one microelectronic chip.

2. Method according to claim 1, wherein the core is provided covered by the polymer material before placing the at least one microelectronic chip and the sections of the yarn in contact with the core.

3. Method according to claim 2, wherein the core is partially covered by the polymer material, the covered areas defining receiving areas for the at least one microelectronic chip.

4. Method according to claim 1, wherein the at least one micro-electronic chip is provided covered by the polymer material before placing the at least one microelectronic chip and the sections of the yarn in contact with the core.

5. Method according to claim 1, wherein the fillers are formed by metallic material or by alumina.

6. Method according to claim 1, wherein the polymer material is a thermoplastic material.

7. Method according to claim 1, wherein an annealing step is performed on the sheathed yarn to polymerize the polymer material and to bond the core, the at least one microelectronic chip and sheathing fibre to one another.

8. Method according to claim 7, wherein an additional annealing step is performed before placing the at least one microelectronic chip in contact with the core so as to soften the polymer material and bond the microelectronic chip.

9. Method according to claim 8, wherein the core and polymer material respectively comprise first and second thermoplastic materials, the first thermoplastic material of the core creeping partially through the turns of the sheathing fibre.

10. Method according to claim 8, wherein the polymer material is formed by a plurality of filaments braided with the core.

11. Method according to claim 1, wherein a plurality of sheathing fibres are wound in superposed manner around the micro-electronic chip and wherein the quantity of polymer material and the quantity of sheathing fibres are chosen such that an external part of the sheathing fibres is devoid of polymer material after creepage.

12. Sheathed yarn comprising:

at least one sheathing fibre wound around a core;

at least one microelectronic chip sandwiched between the core and the at least one sheathing fibre;

a polymer material coating the at least one microelectronic chip, the at least one sheathing fibre comprising a peripheral area devoid of polymer material.

* * * * *